US006695170B2

(12) United States Patent
Moretti

(10) Patent No.: US 6,695,170 B2
(45) Date of Patent: Feb. 24, 2004

(54) DISPENSER CAP WITH SECURITY SEAL FOR FLUID SUBSTANCE CONTAINERS

(75) Inventor: Matteo Moretti, Crema (IT)

(73) Assignee: Lumson S.p.A., Capergnanica (IT)

( * ) Notice: Subject to any disclaimer, the term of this patent is extended or adjusted under 35 U.S.C. 154(b) by 0 days.

(21) Appl. No.: 10/442,088

(22) Filed: May 21, 2003

(65) Prior Publication Data

US 2003/0218026 A1 Nov. 27, 2003

(30) Foreign Application Priority Data

May 22, 2002 (IT) ..... MI2002A1108

(51) Int. Cl.[7] ..... B67B 5/00

(52) U.S. Cl. ..... 222/153.06; 222/521; 220/257.1; 215/250

(58) Field of Search ..... 222/153.06, 519, 222/521, 523, 524, 525, 549, 541.1, 541.6, 503, 153.01; 215/250, 253; 220/257.1, 265, 266

(56) References Cited

U.S. PATENT DOCUMENTS 1,913,807 A * 6/1933 Jones ..... 222/81
2,054,034 A * 9/1936 Conner et al. ..... 215/253
2,066,390 A * 1/1937 Cahoon et al. ..... 215/253
3,010,619 A 11/1961 Gronemeyer, et al.
4,383,623 A 5/1983 Page, III
4,690,304 A 9/1987 Morel
5,004,127 A 4/1991 Morel
5,421,487 A 6/1995 Moretti
5,431,305 A * 7/1995 Kaminski ..... 222/109
5,810,185 A 9/1998 Groesbeck
5,819,969 A * 10/1998 Kalodye ..... 215/251
6,244,476 B1 6/2001 Moretti
6,321,924 B1 * 11/2001 Yurkewicz et al. ..... 215/251

FOREIGN PATENT DOCUMENTS

EP 0 270 134 6/1988
FR 1.468.956 11/1965

* cited by examiner

*Primary Examiner*—Gene Mancene
*Assistant Examiner*—Frederick C Nicolas
(74) *Attorney, Agent, or Firm*—Oblon, Spivak, McClelland, Maier & Neustadt, P.C.

(57) ABSTRACT

Dispenser cap applicable to the mouth of containers of liquid or creamy substances, the cap being sealingly closable and being provided with a security seal which is broken on dispensing the substance for the first time.

3 Claims, 2 Drawing Sheets

DISPENSER CAP WITH SECURITY SEAL FOR FLUID SUBSTANCE CONTAINERS

BACKGROUND OF THE INVENTION

1. Field of the Invention

Dispenser cap applicable to the mouth of a container of liquid or creamy substances and operable by simple rotation to close the container mouth and respectively to open it to enable said substances to be dispensed.

Various types of caps are known for application to the mouth of containers to close or open the passage through said mouth by simply rotating in one direction or the other the most outer component forming part of the cap.

2. Description of Related Art

U.S. Pat. Nos. 5,004,127 and 5,421,487 describe caps of very complex structure, comprising three component parts, one inside the other, with the intermediate part axially movable to interact on the outer part and on the inner part simultaneously.

U.S. Pat. Nos. 4,383,623 and 5,810,185 describe dispenser caps formed of only two component parts, one superposed on and external to the other and mutually engaging via mutually cooperating helical ribs projecting from the facing cylindrical surfaces of the two parts.

U.S. Pat. Nos. 3,010,619, 4,690,304 and 6,244,476 describe dispenser caps, also formed from only two parts superposed one on the other, of which the inner part is applied to and retained by friction on the container mouth, the outer part of the cap having a thread which engages a thread provided on the outer surface of the container mouth.

All the aforesaid dispenser caps comprise an outer component substantially in the form of a cylindrical wall with a dome on the top, in the centre of which there is a hole on which the free end of an elongate appendix forming part of the inner component of the cap is superposable, in such a manner as to sealedly close said hole and hence prevent dispensing of the fluid substance contained in the container on which the cap is applied. The dispensing hole is opened when the outer component of the cap is rotated in the unscrewing direction with respect to the inner component, the fluid substance then being freely withdrawable from the container as no security seal or the like is provided to prevent fraudulent dispensing of the fluid and to indicate that the cap has already been initially opened.

FR-A-1468956 and EP-A-0270134 describe dispenser caps of the aforestated type, formed from two component parts screwed one on the other, but which are provided with a security seal which has to be broken for initial dispensing of the fluid substance contained in the container on which the cap is applied.

FR-A-1468956 shows a security seal consisting of a disc which projects beyond the outer surface of the dispenser cap, in correspondence with and external to the dispensing hole of the cap to which the disc is connected by an annular ring or with projecting teeth which have necessarily to be broken when the cap is used for the first time. The connection between the disc and the body from which it projects must not be too week otherwise it may become detached or broken accidentally during storage and transport, but neither must it be too strong to prevent the disc acting as the seal from being easily torn off when opened for the first time. The result is that when the security seal is torn off manually (by action which has to be exerted on it from outside the cap), a part of the annular ring or teeth which joined it to the body of the cap from which it projected remains rigid with and projecting from the outer surface of this body, in correspondence with the edge of the discharge hole, hence risking to wound the skin of the hand of the person who has used the cap and who passes his hand over the dome of the closed cap to clean it and remove residues of the dispensed substance.

Moreover, as the disc which acts as the seal must project considerably to be easily removed by action exerted on it from the outside, it follows that this disc can be accidentally broken and detached from the cap.

Finally, it will be noted that even while the disc is integral and rigid with the body from which it projects, the body itself can be rotated, thus raising the discharge hole away from the free end of the cap appendix provided to seal against said hole when the cap is closed, with the result that the fluid substance can easily escape from the cap even if the seal is intact.

To overcome these drawbacks, the dispenser cap described in EP-A-0270134 comprises a seal consisting of a disc rigid with the outer body of the cap and positioned in correspondence with its discharge hole, the seal being provided by a membrane or the like disposed between the container mouth and the cap applied to it, the outer body of the cap being lifted away (i.e. into that position which it assumes when the liquid substance is to be dispensed) from the inner body. On initial use, the outer body of the cap is screwed onto the inner body, causing the membrane to break and the disc to separate from the discharge hole (so indicating that the seal has been broken and that the container has been tampered with) by action of the free end of the appendix which projects from the inner body of the cap and which becomes inserted (to seal within it) into the discharge hole of the outer body of the cap. The cap described in EP-A-0270134 presents considerable drawbacks because it must comprise a breakable membrane and because it must be forcibly mounted on the container mouth without breaking the seal, while the two component bodies of the cap are in a position raised one from the outer, i.e. in the normal dispensing position: to make it possible to mount the cap on the container mouth, at the base of the outer body there must be provided a removable supplementary band which rests on a collar projecting from the inner body of the cap, so further increasing its cost and the difficulty of mounting it on the container mouth.

Moreover, as the disc which obstructs the discharge hole in the cap is thrust outwards by the free end of the appendix provided to sealingly close said hole, there is the danger that the disc separates (from the body with which it is rigid) only along a portion of its periphery, so remaining connected to the body, even if only along a limited portion of its edge.

SUMMARY OF THE INVENTION

The main object of the present invention is to provide a dispenser cap with security seal which avoids all the aforesaid problems, is of low production cost, ensures perfect sealing of the cap when in its closed position even when the seal is intact, and enables the security seal to be broken and completely detached by simple normal operation of the cap, leaving the outer surface of the cap completely free and without dangerous projections in correspondence with its discharge hole.

These and further objects are attained by a dispenser cap comprising an outer body superposed on an inner body, the inner body being provided with elements for its sealed mounting on the mouth of a fluid substance container and the outer body being bounded by a lateral wall and a top wall and being constrained to and axially translatable sealedly with respect to the inner body from which there projects an elongate appendix which extends axially towards a discharge hole provided in the top wall of the outer body, the cap being operable between a closed position in which said outer body is lowered onto the inner body with said discharge hole being sealedly closed by the free end of said appendix, and a dispensing position in which said hole is lifted away from the free end of said appendix, characterised by comprising a security seal formed from a discoidal member from which a stem projects, on the free end of the elongate appendix of the inner body there being provided a seat in which said stem is inserted and retained, when the cap is in its closed position with intact seal, the discoidal member resting on the outer surface of the cap outer body in correspondence with said discharge hole when the cap is in its closed position with the seal untouched, the raising of the outer body with respect to the inner body to pass from the cap closed position to the dispensing position causing the discoidal member of the seal to separate from the appendix of the cap inner body to display breakage of the seal.

The discoidal member and the stem of the seal can be connected together by breakable elements or teeth, in which case the stem is irremovably retained in the respective seat of the elongate appendix of the cap inner body; alternatively the discoidal member and the stem of the seal can be rigidly joined together, in which case the stem is forcibly but extractable inserted into the seat of the elongate appendix.

BRIEF DESCRIPTION OF THE DRAWINGS

The structure and characteristics of the dispenser cap with seal according to the present invention will be more apparent from the ensuing description of two embodiments thereof given by way of non-limiting examples with reference to the accompanying drawings in which.

Figure 1:
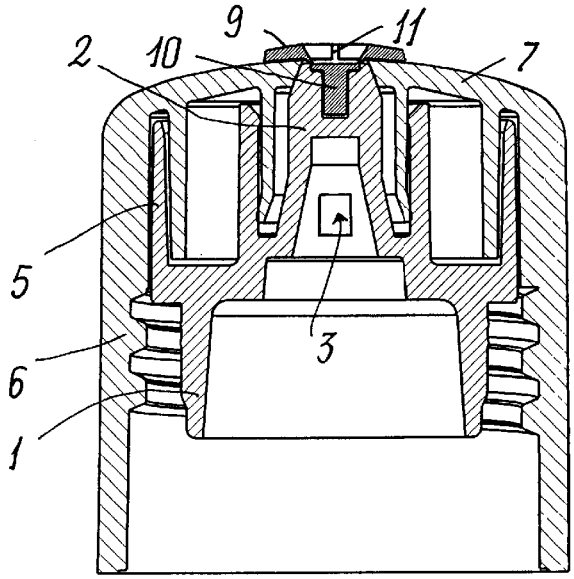
FIGS. 1 and 2 are an axial section through a dispenser cap in its closed position with the security seal intact, and respectively in its open or dispensing position with the seal broken.
Figure 2:
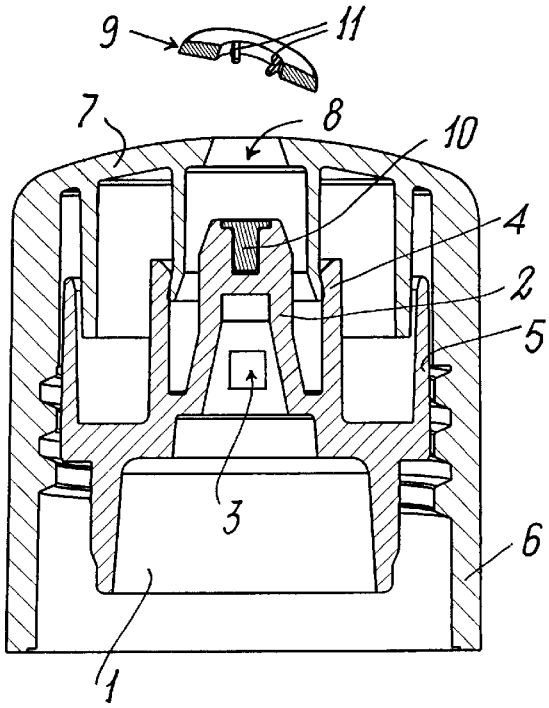

Reference will firstly be made to FIGS. 1 and 2 which schematically show in axial section a dispenser cap formed from only two component parts, i.e. an inner body and an outer body superposed thereon.

The inner body comprises a tubular skirt 1 sealedly insertable into the cavity of the mouth of a container (not shown in the drawings) containing a fluid substance (liquid or creamy) to be dispensed; an axially extending elongate appendix 2 in which windows or apertures 3 are provided; and tubular walls 4, 5 intended to guide the outer body and to seal against it.

The outer body is bounded by a cylindrical lateral wall 6 and by a top wall 7, in the lateral wall 6 there being provided a projecting thread (not numbered for simplicity but clearly visible in the drawings) which enables it to be screwed, with consequent axial translation, on a thread projecting from the outer surface of the mouth of the container on which it is assumed that the cap has been mounted, in the top wall 7 there being provided a discharge hole 8 coaxial with the appendix 2, the free end of which can be inserted into said hole to seal it when the cap is closed (FIG. 1).

The dispenser cap described up to this point is equal to that illustrated in U.S. Pat. No. 6,244,476, it therefore not being necessary to provide further explanations regarding its structure or its operation. It is however important to note that the structure of the dispenser cap could be different from that shown in the accompanying drawings, for example it could be as shown in any one of the prior patents cited in the introduction to the present description.

The fundamental characteristic of the present invention relates to the fact that the dispenser cap is provided with a security seal which must be broken or removed at the moment in which the cap is used for the first time.

Figure 3:
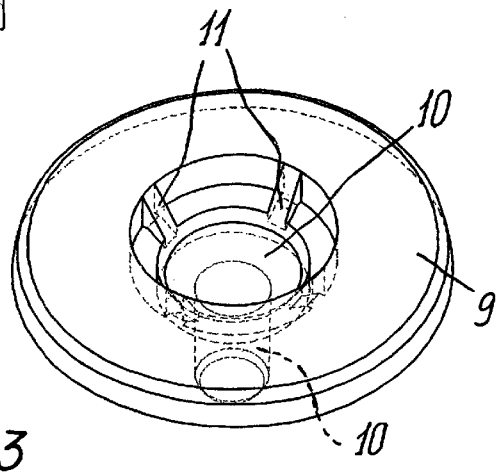
FIG. 3 is an enlarged perspective view of the seal shown in section in FIGS. 1 and 2.

In the embodiment shown in FIGS. 1 and 2, this seal (shown in perspective view on an enlarged scale in FIG. 3) consists of a discoidal member 9 and a stem 10 which are connected together by a series of breakable teeth 11.

When the dispenser cap is in its closed position (FIG. 1) the stem 10 is forcibly inserted in a seat provided in the free end of the appendix 2, such that the discoidal member 9 rests on the outer surface of the wall 7, in correspondence with the discharge hole 8.

It is clear that, under these conditions, the cap can be easily screwed onto the mouth of a container without damaging the seal because the free end of the appendix 2 is sealedly positioned in the hole 8 and is urged downwards (with respect to the figures) by the top wall 7 of the cap outer body.

It will now be assumed that the cap is to be opened for the first time: with the inner body 1-3 retained by friction on the container mouth, when the outer body 6, 7 of the cap is rotated in the direction to unscrew it from the thread provided on the outside of the appendix 2, the discoidal member 9 is raised upwards (with respect to the figures) by the wall 7 of the outer body 6, 7 to cause the teeth 11 to brake and the discoidal member 9 to separate from the stem 10 (FIG. 2), so enabling the fluid substance to be dispensed through the dispenser cap but making it evident that the seal has been broken.

Figure 4:
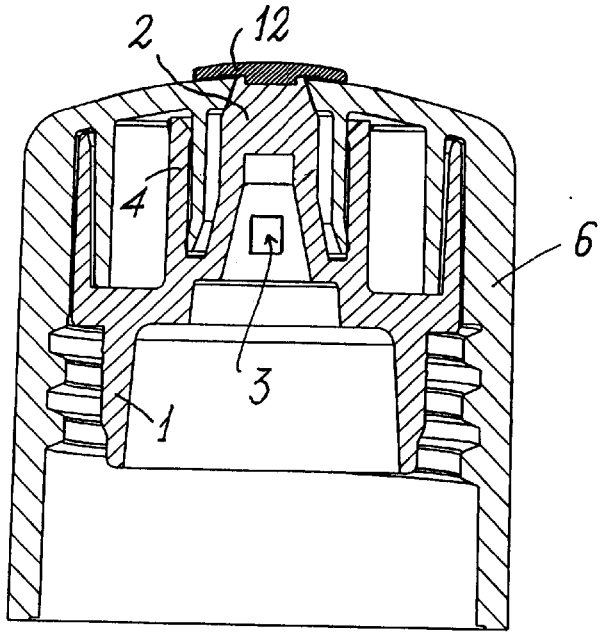
FIG. 4 is an axial section through a closed dispenser cap provided with a different security seal.

FIG. 4 shows a dispenser cap which is substantially identical to that of FIGS. 1 and 2 (the same reference numerals as those already stated being hence used for simplicity), it differing therefrom substantially in that the security seal consists of a discoidal member 12 to which there is securely joined a stem 13 which is forced into and removably retained in a profiled seat 14 (FIG. 5) provided in the end of the appendix 2.

Figure 5:
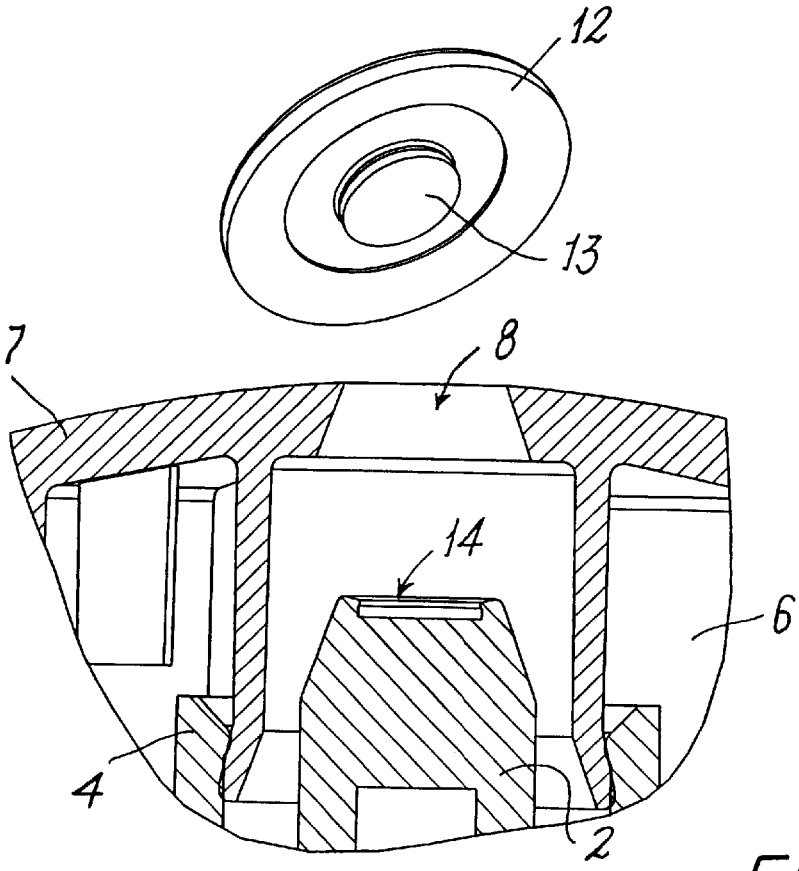
FIG. 5 shows on an enlarged scale a portion of the cap of FIG. 4, but in its open position and with the security seal removed.

When the dispenser cap is opened for the first time, the wall 7 of the outer body exerts traction on the disc 12 of the seal, causing the stem 7 to emerge from the seat 14, as shown on an enlarged scale in the (open) cap portion shown open on FIG. 5: after its extraction from the seat 14 of the appendix 2, the stem 13 of the seal can no longer be reinserted into the same seat because this cannot be done by hand, but only by using an appropriate implement.

The important characteristics of the described seal consist of the fact that the seal is applied to the appendix 2 when this appendix seals the discharge hole 8 of the cap; the fact that the seal can be easily torn or opened only and simply by moving the outer body axially relative to the inner body of the cap (hence the seal cannot be broken accidentally); the fact that when the seal has been torn away or removed from the cap, no burrs or broken portions of the seal project from the smooth outer surface of the top wall 7 of the cap to damage the skin of a person passing a hand over the outside of the cap; and the fact that the cap, when in its closed position and with the seal already applied to it, can be easily forced onto the mouth of a container containing the fluid substance to be dispensed.

We claim:

1. A dispenser cap with security seal for fluid substance containers, comprising an outer body superposed on an inner body, the inner body being provided with elements for its sealed mounting on the mouth of a fluid substance container and the outer body being bounded by a lateral wall and a top wall and being constrained to and axially translatable sealedly with respect to the inner body, from which there projects an elongate appendix which extends axially towards a discharge hole provided in the top wall of the outer body, the cap being operable between a closed position in which said outer body is lowered onto the inner body with said discharge hole being sealedly closed by the free end of said appendix, and a dispensing position in which said hole is lifted away from the free end of said appendix, the cap further comprising a security seal formed from a discoidal member from which a stem projects, on the free end of the elongate appendix of the inner body there being provided a seat in which said stem is inserted and retained, when the cap is in its closed position with intact seal, the discoidal member resting on the outer surface of the cap outer body in correspondence with said discharge hole when the cap is in its closed position with the seal untouched, the raising of the outer body with respect to the inner body to pass from the cap closed position to the dispensing position causing the discoidal member of the seal to separate from the appendix of the cap inner body to display breakage of the seal.

2. A dispenser cap as claimed in claim 1, wherein the discoidal member and the stem of the seal are connected together by breakable elements, said stem being forced into and irremovably retained in said seat of the elongate appendix of the cap inner body.

3. A dispenser cap as claimed in claim 1, wherein the discoidal member and the stem of the seal are rigidly joined together, said stem being forced into and removably retained within said seat of the elongate appendix of the cap inner body.

* * * * *